US009852484B1

(12) United States Patent
Fonts et al.

(10) Patent No.: US 9,852,484 B1
(45) Date of Patent: Dec. 26, 2017

(54) PROVIDING DEMAND RESPONSE PARTICIPATION

(71) Applicant: OPOWER, INC., Arlington, VA (US)

(72) Inventors: Agustin Fonts, Santa Clara, CA (US); Ryan Devenish, San Francisco, CA (US); David Byron, Oakland, CA (US); Thomas E. Darci, Oakland, CA (US)

(73) Assignee: OPOWER, INC., Arlington, VA (US)

( * ) Notice: Subject to any disclaimer, the term of this patent is extended or adjusted under 35 U.S.C. 154(b) by 568 days.

(21) Appl. No.: 14/289,309

(22) Filed: May 28, 2014

Related U.S. Application Data

(60) Provisional application No. 61/937,249, filed on Feb. 7, 2014.

(51) Int. Cl.
*G06Q 50/06* (2012.01)

(52) U.S. Cl.
CPC ..... *G06Q 50/06* (2013.01)

(58) Field of Classification Search
CPC ..... G06Q 50/06
See application file for complete search history.

(56) References Cited

U.S. PATENT DOCUMENTS

| | | | |
|---|---|---|---|
| 4,334,275 | A | 6/1982 | Levine |
| 4,843,575 | A | 6/1989 | Crane |
| 5,513,519 | A | 5/1996 | Cauger et al. |
| 5,566,084 | A | 10/1996 | Cmar |
| 5,717,609 | A | 2/1998 | Packa et al. |
| 5,855,011 | A | 12/1998 | Tatsuoka |
| 5,873,251 | A | 2/1999 | Iino |
| 5,930,773 | A | 7/1999 | Crooks et al. |
| 5,948,303 | A | 9/1999 | Larson |
| 6,035,285 | A | 3/2000 | Schlect et al. |
| 6,088,688 | A | 7/2000 | Crooks et al. |
| 6,295,504 | B1 | 9/2001 | Ye et al. |
| 6,327,605 | B2 | 12/2001 | Arakawa et al. |
| 6,701,298 | B1 | 3/2004 | Jutsen |
| 6,732,055 | B2 | 5/2004 | Bagepalli et al. |
| 6,778,945 | B2 | 8/2004 | Chassin et al. |

(Continued)

FOREIGN PATENT DOCUMENTS

| | | |
|---|---|---|
| AU | 2010315015 | 7/2014 |
| CA | 2779754 | 5/2011 |

(Continued)

OTHER PUBLICATIONS

International Search Report and Written Opinion for PCT Application No. PCT/US2015/038692, dated Sep. 24, 2015, 13 pages.

(Continued)

*Primary Examiner* — Sean Shechtman
*Assistant Examiner* — Tri T Nguyen
(74) *Attorney, Agent, or Firm* — Cooper Legal Group, LLC

(57) ABSTRACT

A method and system for providing information about participation in a utility demand response (DR) event by a plurality of utility customers receives information regarding participation in the DR event by the plurality of utility customers, determines DR event feedback information using a processor and the received information regarding participation in the DR event, and provides the DR event feedback information to at least one utility customer from among the plurality of utility customers.

15 Claims, 11 Drawing Sheets

(56) References Cited

U.S. PATENT DOCUMENTS 6,785,620 B2 8/2004 Kishlock et al.
6,972,660 B1 12/2005 Montgomery, Jr. et al.
7,020,508 B2 3/2006 Stivoric et al.
7,073,073 B1 7/2006 Nonaka et al.
7,073,075 B2 7/2006 Freyman et al.
7,136,710 B1 11/2006 Hoffberg et al.
7,142,949 B2 11/2006 Brewster et al.
7,149,727 B1 12/2006 Nicholls et al.
7,200,468 B2 4/2007 Ruhnke et al.
7,243,044 B2 7/2007 McCalla
7,333,880 B2 2/2008 Brewster et al.
7,356,548 B1 4/2008 Culp et al.
7,444,251 B2 10/2008 Nikovski et al.
7,460,502 B2 12/2008 Arima et al.
7,460,899 B2 12/2008 Almen
7,552,030 B2 6/2009 Guralnik et al.
7,561,977 B2 7/2009 Horst et al.
7,991,513 B2 8/2011 Pitt
8,065,098 B2 11/2011 Gautam
8,166,047 B1 4/2012 Cohen et al.
8,180,591 B2 5/2012 Yuen et al.
8,239,178 B2 8/2012 Gray et al.
8,260,468 B2 9/2012 Ippolito et al.
8,275,635 B2 9/2012 Stivoric et al.
8,280,536 B1 10/2012 Fadell et al.
8,348,840 B2 1/2013 Heit et al.
8,375,118 B2 2/2013 Hao et al.
8,417,061 B2 4/2013 Kennedy et al.
8,478,447 B2 7/2013 Fadell et al.
8,489,245 B2 7/2013 Carrel et al.
8,583,288 B1 11/2013 Rossi et al.
8,630,741 B1 1/2014 Matsuoka et al.
8,660,813 B2 2/2014 Curtis et al.
8,690,751 B2 4/2014 Auphan
8,751,432 B2 6/2014 Berg-Sonne et al.
8,805,000 B2 8/2014 Derby et al.
9,031,703 B2 5/2015 Nakamura et al.
2002/0065581 A1 5/2002 Fasca
2002/0178047 A1 11/2002 Or et al.
2002/0198629 A1 12/2002 Ellis
2003/0011486 A1 1/2003 Ying
2003/0018517 A1 1/2003 Dull et al.
2003/0023467 A1 1/2003 Moldovan
2003/0216971 A1 11/2003 Sick et al.
2004/0024717 A1 2/2004 Sneeringer
2004/0111410 A1 6/2004 Burgoon et al.
2004/0140908 A1 7/2004 Gladwin et al.
2005/0257540 A1 11/2005 Choi et al.
2006/0089851 A1 4/2006 Silby et al.
2006/0103549 A1 5/2006 Hunt et al.
2007/0061735 A1 3/2007 Hoffberg et al.
2007/0203860 A1 8/2007 Golden et al.
2007/0213992 A1 9/2007 Anderson et al.
2007/0255457 A1 11/2007 Whitcomb et al.
2007/0260405 A1 11/2007 McConnell et al.
2008/0027885 A1 1/2008 van Putten et al.
2008/0167535 A1 7/2008 Stivoric et al.
2008/0195561 A1 8/2008 Herzig
2008/0281473 A1 11/2008 Pitt
2008/0281763 A1 11/2008 Yliniemi
2008/0306985 A1 12/2008 Murray et al.
2009/0106202 A1 4/2009 Mizrahi
2009/0204267 A1 8/2009 Sustaeta et al.
2009/0326726 A1 12/2009 Ippolito et al.
2010/0025483 A1 2/2010 Hoeynck et al.
2010/0076835 A1 3/2010 Silverman
2010/0082174 A1 4/2010 Weaver
2010/0099954 A1 4/2010 Dickinson et al.
2010/0138363 A1 6/2010 Batterberry et al.
2010/0156665 A1 6/2010 Krzyzanowski et al.
2010/0179704 A1 7/2010 Ozog
2010/0198713 A1 8/2010 Forbes, Jr. et al.
2010/0217452 A1 8/2010 McCord et al.
2010/0217549 A1 8/2010 Galvin et al.
2010/0217550 A1 8/2010 Crabtree et al.
2010/0217642 A1 8/2010 Crubtree et al.
2010/0217651 A1 8/2010 Crabtree et al.
2010/0232671 A1 9/2010 Dam et al.
2010/0286937 A1 11/2010 Hedley et al.
2010/0289643 A1 11/2010 Trundle et al.
2010/0324962 A1 12/2010 Nesler et al.
2010/0332373 A1 12/2010 Crabtree et al.
2011/0022242 A1* 1/2011 Bukhin ..... G06Q 10/06 700/291
2011/0022429 A1 1/2011 Yates et al.
2011/0023045 A1 1/2011 Yates et al.
2011/0040666 A1 2/2011 Crabtree et al.
2011/0061014 A1 3/2011 Frader-Thompson et al.
2011/0063126 A1 3/2011 Kennedy et al.
2011/0066300 A1* 3/2011 Tyagi ..... H02J 3/14 700/291
2011/0106316 A1 5/2011 Drew et al.
2011/0106328 A1 5/2011 Zhou et al.
2011/0106471 A1 5/2011 Curtis et al.
2011/0153102 A1 6/2011 Tyagi et al.
2011/0178842 A1 7/2011 Rane et al.
2011/0178937 A1 7/2011 Bowman
2011/0205245 A1 8/2011 Kennedy et al.
2011/0231320 A1 9/2011 Irving
2011/0251730 A1 10/2011 Pitt
2011/0251807 A1 10/2011 Rada et al.
2011/0282505 A1 11/2011 Tomita et al.
2012/0036250 A1 2/2012 Vaswani et al.
2012/0053740 A1 3/2012 Venkatakrishnan et al.
2012/0065805 A1* 3/2012 Montalvo ..... G06Q 10/06 700/297
2012/0066168 A1 3/2012 Fadell et al.
2012/0078417 A1 3/2012 Connell, II et al.
2012/0084063 A1 4/2012 Drees et al.
2012/0215369 A1 8/2012 Desai et al.
2012/0216123 A1 8/2012 Shklovskii et al.
2012/0259678 A1 10/2012 Overturf et al.
2012/0290230 A1 11/2012 Berges Gonzalez et al.
2012/0310708 A1 12/2012 Curtis et al.
2013/0060531 A1 3/2013 Burke et al.
2013/0060720 A1 3/2013 Burke
2013/0173064 A1 7/2013 Fadell et al.
2013/0253709 A1 9/2013 Renggli et al.
2013/0254151 A1* 9/2013 Mohagheghi ..... G06Q 30/0621 706/46
2013/0261799 A1 10/2013 Kuhlmann et al.
2013/0262040 A1 10/2013 Buckley
2014/0006314 A1 1/2014 Yu et al.
2014/0019319 A1 1/2014 Derby et al.
2014/0074300 A1 3/2014 Shilts et al.
2014/0107850 A1 4/2014 Curtis
2014/0148706 A1 5/2014 Van Treeck et al.
2014/0163746 A1 6/2014 Drew et al.
2014/0207292 A1 7/2014 Ramagem et al.
2014/0277795 A1* 9/2014 Matsuoka ..... G06Q 30/0202 700/291
2014/0337107 A1 11/2014 Foster
2015/0019032 A1* 1/2015 Koch ..... G06Q 50/06 700/286
2015/0206083 A1* 7/2015 Chen ..... G06Q 10/06313 705/7.23
2015/0206084 A1* 7/2015 Herberg ..... G06Q 50/06 705/7.23
2015/0227846 A1 8/2015 Mercer et al.
2015/0267935 A1 9/2015 Devenish et al.
2015/0269664 A1 9/2015 Davidson
2015/0310019 A1 10/2015 Royer et al.
2015/0310463 A1 10/2015 Turfboer et al.
2015/0310465 A1 10/2015 Chan et al.

FOREIGN PATENT DOCUMENTS

CA 2832211 11/2012
DE 3703387 8/1987
DE 102011077522 12/2012
EP 0003010 7/1979
EP 2705440 3/2014
EP 2496991 9/2014

(56) References Cited

FOREIGN PATENT DOCUMENTS

| | | |
|---|---|---|
| GB | 1525656 | 9/1978 |
| GB | 2238405 | 5/1991 |
| JP | 2000-270379 | 9/2000 |
| JP | 2004-233118 | 8/2004 |
| JP | 2006-119931 | 5/2006 |
| JP | 2007-133468 | 5/2007 |
| JP | 2011-027305 | 2/2011 |
| JP | 2012-080679 | 4/2012 |
| JP | 2012-080681 | 4/2012 |
| JP | 2013-020307 | 1/2013 |
| WO | WO 03/102865 | 12/2003 |
| WO | WO 03/104941 | 12/2003 |
| WO | WO 2008/101248 | 8/2008 |
| WO | WO 2009/085610 | 7/2009 |
| WO | WO 2011/057072 | 5/2011 |
| WO | WO 2012/112358 | 8/2012 |
| WO | WO 2012/154566 | 11/2012 |
| WO | WO 2014/004148 | 1/2014 |
| WO | WO 2014/182656 | 11/2014 |

OTHER PUBLICATIONS

International Preliminary Report on Patentability for PCT Application No. PCT/US2010/055621, dated May 15, 2012, 8 pages.
International Search Report and Written Opinion for PCT Application No. PCT/US2010/055621, dated Dec. 23, 2010, 9 pages.
International Search Report and Written Opinion for PCT Application No. PCT/US2012/036539, dated Jul. 6, 2012, 8 pages.
International Preliminary Report on Patentability for PCT Application No. PCT/US2012/036539, dated Nov. 21, 2013, 7 pages.
International Search Report and Written Opinion for PCT Application No. PCT/US2013/046126, dated Aug. 22, 2013, 9 pages.
International Preliminary Report on Patentability for PCT Application No. PCT/US2013/046126, dated Jan. 8, 2015, 8 pages.
International Search Report for PCT Application No. PCT/US2014/036901, dated Aug. 28, 2014, 3 pages.
Patent Examination Report No. 1 for Australian Patent Application No. 2010315015, dated Dec. 17, 2013, 3 pages.
Extended European Search Report for European Patent Application No. 12782569.3, dated Nov. 27, 2014, 7 pages.
Author Unknown, "An Inconvenient Truth," Jan. 9, 2008, 2 pages, available at http://web.archive.org/web/2008019005509/http://www.climatecrisis.net/takeaction/carbonca/.
Author Unknown, "Calculate Your Impact," Jul. 28, 2008, 4 pages, available at http://web.archive.org/web/20080728161614/http://green.yahoo.com/calculator/.
Author Unknown, "Carbon Footprint Calculator: What's My Carbon Footprint?" The Nature Conservancy, Jul. 8, 2008, 8 pages, available at http://web.archive.org/web/20080708193253/http://www.nature.org/initiatives/climatechange/calculator/2008.
Author Unknown, "CoolClimate Calculator," May 19, 2008, 15 pages, available at http://web.archive.orgi/web/20080519220643/bie.berkeley.edu/coolcale/calculations.html.
Author Unknown, "Lifecycle Climate Footprint Calculator," Berkeley Institute of the Environment, Nov. 23, 2007, 6 pages, available at http://web.archive.org/web/20071123115832/http://bie.berkeley.edu/calculator.
Author Unknown, "More than just a thermostat.," http://www.ecobee.com/, 4 pages, Jul. 16, 2013.
Author Unknown, "Popups Climate Change: Carbon Calculator—Greenhouse Gas and Carbon Dioxide Calculator Wed Pages," The Nature Conservancy, 5 pages, Feb. 29, 2008, available at http://web.archive.org/web/20080229072420/www.nature.org/popups/misc/art20625.html.
Bailey, Timothy, et al., "Fitting a Mixture Model by Expectation Maximization to Discover Motifs in Biopolymers," UCSD Technical Report CS94-351, Proceedings of the Second International Conf. on Intelligent Systems for Molecular Biology, 1994, 33 pages.
Chen, Hanfeng, et al., "Testing for a Finite Mixture Model With Two Components," Journal of the Royal Statistical Society, Series B, vol. 66, No. 1, 26 pages, 2004.
De Prensa, Boletine, "TXU Energy Budget Alerts Give Consumers Control of Electricity Costs," TXU Energy, http://www.txu.com/es/about/press, 2 pages, May 23, 2012.
Deb, Partha, "Finite Mixture Models," Hunter College and the Graduate Center, CUNY NBER, FMM Slides, 42 pages, Jul. 2008.
D'Urso, M., et al., "A Simple Strategy for Life Signs Detection via an X-Band Experimental Set-Up," Progress in Electromagnectics Research C, vol. 9, pp. 119-129 (2009).
Eckmann, J.P., et al., "Ergodic theory of chaos and strange attractors," Reviews of Modern Physics, vol. 57, No. 3, Part I, pp. 617-656, Jul. 1985.
Espinoza, Marcelo, et al., "Short-Term Load Forecasting, Profile Identification, and Customer Segmentation: A Methodology Based on Periodic Time Series," IEEE Transactions on Power Systems, vol. 20, No. 3, pp. 1622-1630, Aug. 2005.
Fels, Margaret F., "PRISM: An Introduction," Elsevier Sequoia, Energy and Buildings, vol. 9, pp. 5-18, 1986.
Fels, Margaret F., et al., Seasonality of Non-heating Consumption and Its effect on PRISM Results, Elsevier Sequoia, Energy and Buildings, vol. 9, pp. 139-148, 1986.
Figueiredo, Vera, et al., "An Electric Energy Consumer Characterization Framework Based on Data Mining Techniques," IEEE Transactions on Power Systems, vol. 20, No. 2, pp. 596-602, May 2005.
Fitbit® Official Site, "Flex, One & Zip Wireless Activity & Sleep Trackers," http://www.fitbit.com/, 4 pages, Jul. 15, 2013.
Friedman, Jerome, et al., "Regularization Paths for Generalized Linear Models via Coordinate Descent," Journal of Statistical Sotfware, vol. 33, Iss. 1, pp. 1-22, Jan. 2010.
Goldberg, Miriam L., et al., "Refraction of PRISM Results into Components of Saved Energy," Elsevier Sequoia, Energy and Buildings, vol. 9, pp. 169-180, 1986.
Jansen, R.C., "Maximum Likelihood in a Generalized Linear Finite Mixture Model by Using the EM Algorithm," Biometrics, vol. 49, pp. 227-231, Mar. 1993.
Jawbone, "Know yourself. Live better." https://jawbone.com/up/, 7 pages, Jul. 15, 2013.
Leisch, Friedrich, "FlexMix: A General Framework for Finite Mixture Models and Latent Class Regression in R," Journal of Statistical Software, http://www.jstatsoft.org/, vol. 11 (8), pp. 1-18, Oct. 2004.
Liang, Jian, et al. "Load Signature Study-Part II: Disaggregation Framework, Simulation, and Applications," IEEE Transactions on Power Delivery, vol. 25, No. 2, pp. 561-569, Apr. 2010.
Liang, Jian, et al., "Load Signature Study-Part I: Basic Concept, Structure, and Methodology," IEEE Transactions on Power Delivery, vol. 25, No. 2, pp. 551-560, Apr. 2010.
Mint.com, "Budgets you'll actually stick to," Budgeting-Calculate and Categorize your spending, http://www.mint.com/how-it-works/budgeting/, 2 pages, Jul. 12, 2013.
Mint.com, "We're always on alert." Alerts for bills, fees & going over budget, https://www.mint.com/how-it-works/alerts/, 2 pages, Jul. 12, 2013.
Mori, Hiroyuki, "State-of-the-Art Overview on Data Mining in Power Systems," IEEE, pp. 33-37, 2006.
Muthen, Bengt, et al., Finite Mixture Modeling with Mixture Outcomes Using the EM Algorithm, Biometrics, vol. 55, pp. 463-469, Jun. 1999.
Nest, "The Learning Thermostat," http://www.nest.com/, 2 pages, Jul. 15, 2013.
Nike.com, "Nike + FuelBand. Tracks your all-day activity and helps you do more . . . ," http://www.nike.com/us/en_us/c/nikeplus-f..uelband,_7 pages, Jul. 15, 2013.
Rose, O. "Estimation of the Hurst Parameter of Long-Range Dependent Time Series," University of Wuirzburg, Institute of Computer Science, Research Report Series, Report No. 137, 15 pages, Feb. 1996.
Sawka, Michael N., et al., "Human Adaptations to Heat and Cold Stress," RTOMP-076, 16 pages, Oct. 2001.

(56) References Cited

OTHER PUBLICATIONS

Stephen, Bruce, et al. "Domestic Load Characterization Through Smart Meter Advance Stratification," IEEE Transactions on Smart Grid, Power Engineering Letter, vol. 3, No. 3, pp. 1571-1572, Sep. 2012.
Stoop, R., et al., "Calculation of Lyapunov exponents avoiding spurious elements," Physica D 50, pp. 89-94, May 1991.
Wang, Xiaozhe, et al. "Rule induction for forecasting method selection: meta-learning the characteristics of univariate time series," Faculty of information Technology, Department of Econometrics and Business Statistics, Monash University, pp. 1-34.
Wang, Xiaozhe, et al., "Characteristic-Based Clustering for Time Series Data," Data Mining and Knowledge Discovery, Springer Science & Business Media, LLC, vol. 13, pp. 335-364 (2006).
Wehrens, Ron, et al. "Self- and Super-organizing Maps in R: The kohonen Package," Journal of Statistical Software, vol. 21, Iss. 5, pp. 1-19, Oct. 2007.
Wikipedia, "Akaike information criterion," 6 pages, Aug. 17, 2012.
Wikipedia, "Mixture model," 10 pages, Oct. 7, 2012.

* cited by examiner 600-3

600-4

PROVIDING DEMAND RESPONSE PARTICIPATION

CROSS-REFERENCE TO RELATED APPLICATION

This application claims priority to and the benefit of U.S. Provisional Patent Application No. 61/937,249, filed on Feb. 7, 2014, the disclosure of which is incorporated by reference herein in its entirety.

BACKGROUND

Field

The present disclosure relates generally to energy conservation and more specifically to increasing utility customer participation in demand response (DR) events.

Description of the Related Art

During certain peak use events, energy systems may not be able to meet energy demand or energy prices may spike. For example, during a heat wave or when a power plant needs to be taken offline for maintenance, blackouts, brownouts, or energy price spikes may occur due to shortages in energy. Accordingly, during a peak use event, a utility company may initiate a DR event. A DR event refers to actions that are taken to reduce energy demand during these peak use events.

For example, a DR event may involve remotely controlling utility customers' thermostats to reduce energy consumption of heating/cooling systems during a peak use event, either by cycling heating/cooling systems off for a period of time or by adjusting a thermostat set point. However, because utility customers are generally worried about being uncomfortable during DR events and because DR events are generally optional, utility customers often opt out of DR events.

In the related art, utility companies may offer financial incentives to utility customers who participate in DR events during peak use events. However, these incentives may be expensive for the utility companies to provide and utility customers may still opt out of these DR events.

BRIEF DESCRIPTION OF THE DRAWINGS

A general architecture that implements the various features of the disclosure will now be described with reference to the drawings. The drawings and the associated descriptions are provided to illustrate embodiments of the disclosure and not to limit the scope of the disclosure. Throughout the drawings, reference numbers are reused to indicate correspondence between referenced elements.

DETAILED DESCRIPTION

Figure 1:
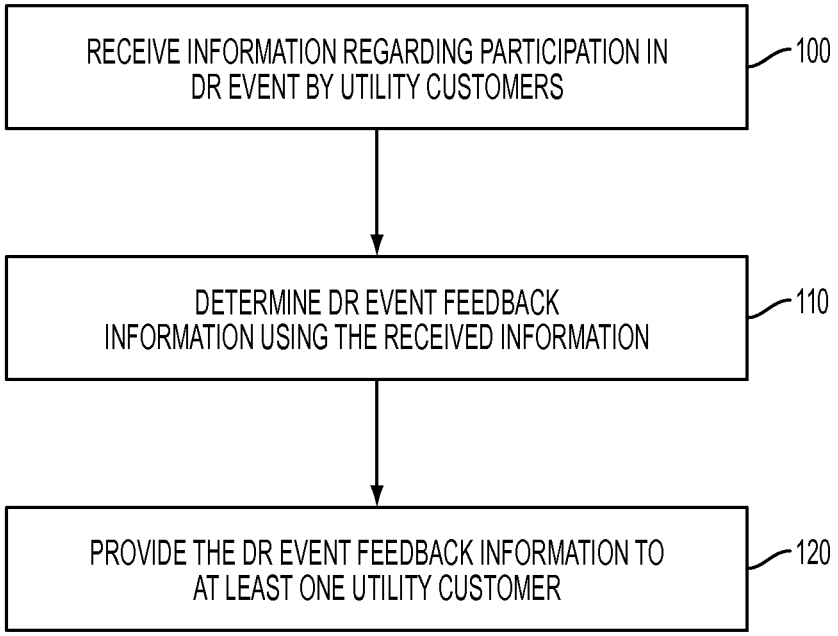
FIG. 1 is a flow diagram illustrating a process for providing DR event feedback information to at least one utility customer, according to an embodiment.

Embodiments may address at least some of the above problems and/or disadvantages and other disadvantages not described above. Also, embodiments are not required to overcome the disadvantages described above, and an embodiment may not overcome any of the problems described above.

An embodiment employs behavioral science techniques to encourage utility customers to participate in DR events (e.g., to not opt out of DR events). In particular, utility customers are segmented into groups according to different metrics to encourage group participation. For example, utility customers may be segmented by a zip code or neighborhood associated with each utility customer (e.g., where each utility customer resides), demographic information, socioeconomic data, particular utility programs that utility customers are enrolled in, utility substations that utility customers use, or other targeting algorithms. Thereafter, DR event feedback information is generated based on utility customer participation in DR programs and may be provided to the utility customers in the group.

For instance, when a utility customer is asked to enroll in a DR event or attempts to opt out of a DR event, DR event feedback information such as "98 percent of your neighbors are participating" may be provided to the utility customer. Because utility customers are provided with information corresponding to how they compare with their peers (e.g., utility customers in the same neighborhood, or utility customers in the same utility program), they may be encouraged to conform to, or exceed, normative behavior. For example, if a utility customer sees that 98% of his or her neighbors are participating in a DR event, the utility customer may be much less likely to opt out of the DR event.

The term "peak use event" as used herein may refer to an event that occurs or a situation in which an energy system (e.g., an energy grid) may become compromised or when energy price spikes occur due to energy shortages or predicted shortages in the energy system. For example, as set forth above, a peak use event may occur during a heat wave when utility customers are using (or are expected to be using) their air conditioning systems to stay cool, and as a result, energy use in the energy system may exceed (or be expected to exceed) a certain threshold level.

Accordingly, in order to avoid blackouts, brownouts, and/or energy price spikes, which are implemented to discourage energy use during certain times or occur as a consequence of high levels of energy use, utility companies have begun utilizing DR programs. The term "DR program" as used herein may refer to a program in which utility customers agree to lower their power consumption by participating in DR events during peak use event. The term "DR event" as used herein may refer to an implementation of a DR program during which participating utility customers' thermostats are remotely controlled by a utility company so as to reduce energy consumption of heating/cooling systems during a peak use event. For example, during a heat wave, energy consumption can be reduced by cycling off an air conditioning unit for periods of time or adjusting a thermostat set point. In other implementations of DR programs, utility customers may control their thermostats or other energy consuming devices themselves in order to reduce energy consumption during a peak event. The DR event may also include an enrollment or opt out period before or during a peak use event for which the DR event is initiated.

According to an embodiment, the DR feedback event information may be provided to utility customers in real-time, prior to, during, or after a DR event. For example, the DR feedback event information may be transmitted to a client device, such as a utility customer's smartphone, mobile device, computer, or thermostat mounted in a utility customer's home, and displayed on the client device. Alternatively, the DR feedback event information may be transmitted to and displayed on a website accessible to a utility customer (e.g., the utility customer's utility account).

Because information about participation in DR events may be provided to utility customers in real-time, utility customers are made aware of what other utility customers are doing during the DR event, and, as a whole, will learn what perceived normal behavior is and will be more likely to conform with that learned behavior. According to an embodiment, using behavioral comparisons is effective for driving outliers (i.e., utility customers who opt out of DR events) to normative behavior (i.e., not opting out of DR events) because, in general, individuals do not want to be perceived as doing something incorrectly or outside of what is considered to be normal. Instead, individuals, especially within a group of their peers, want to conform to or exceed the behavior practiced by their peers. For example, if a large number of utility customers participate in DR events, outliers may be encouraged to participate in the DR events and/or not opt out. Further, if there is a particularly hot day in which DR event is necessary to avoid blackouts or brownouts, utility customers, who may have otherwise opted out, may not opt out in order to avoid deviating from what is perceived as being normal behavior.

FIG. 1 is a flow diagram illustrating a process for providing DR event feedback information to at least one utility customer. DR event feedback information may correspond to at least one of a percentage, a ratio, or a number of utility customers participating in a DR event. According to one embodiment, when a utility customer is participating in a DR event, the thermostat of the utility customer can be controlled by the utility company to reduce energy consumption. For example, on a hot day when a utility customer is using his or her air conditioning system, the utility provider may reduce usage of the air conditioning system (e.g., by setting a thermostat set point that uses less electricity) or cycle off for periods of time the air conditioning system of a utility customer who is participating in a DR event, during the DR event. In order to encourage the utility customer to enroll in or to not opt out of a DR event, the DR event feedback information may be displayed in a user interface (UI) such as a UI in which the thermostat set point is adjusted.

Referring to FIG. 1, information regarding participation in a DR event by a plurality of utility customers is received in block 100. The information may be received directly from a client device such as a thermostat, mobile device, or other device, from the utility company (e.g., from a server or database maintained by the utility), from a thermostat manufacturer, from a third-party database, or any other source, and will be described in greater detail below with reference to FIG. 4. According to an embodiment, the information may include whether a utility customer is enrolled or registered in a DR program, whether the utility customer is currently participating in a future or current DR event, or whether the utility customer is requesting to opt out of the DR program or DR event. This will be described in greater detail below with reference to FIG. 4.

Next, in block 110, DR event feedback information is determined using the received participation information. In an embodiment, utility customers may be segmented into one or more groups and metrics may be generated based on participating information for utility customers in the one or more groups. The utility customers may be segmented in such a way as to maximize participation in DR events. For example, a utility customer may be more likely to respond to feedback indicating high participation among utility customers that are similar to them (e.g., neighbors). Additionally, a utility customer may be more likely to respond to feedback indicating high participation among utility customers that they aspire to be like (e.g., energy efficient neighbors).

Therefore, according to an embodiment, utility customers may be segmented into one or more groups of similar utility customers. Similar utility customers may be identified based on various factors/characteristics and signals including, for example, location (e.g., residential addresses, work addresses, etc.), socioeconomic data, demographic data, building data, weather data, etc. Location information may include a zip code, a city, a neighborhood, global positioning system (GPS) coordinates, an area around a location (e.g., a four block radius around a utility customer's home), weather patterns, characteristics, or other weather data near a location, or any other location information. Other information used to identify similar users may include household income, property values, a number of occupants of a residence, a number of children in a family, a number of bedrooms and/or bathrooms in a building, a size (e.g., square footage) of a building, a number of floors in a building, a building type, or any other information that may be obtained about a utility customer or calculated for a utility customer. In some embodiments, the information may be retrieved from the customer and stored on a server of the system or obtained from a $3^{rd}$ party system. However, the embodiments are not limited thereto.

For instance, a group that includes all of the utility customers in a certain neighborhood may be selected, as a utility customer may be more likely to enroll or continue participating in DR events when provided with feedback on the participation of neighbors because the utility customer may be motivated to conform his or her behavior with that of his or her neighbors. Alternatively or additionally, a subset of the group of neighbors that includes utility customers in the neighborhood that are energy efficient may be selected. A utility customer may be more likely to enroll or continue participating in DR events when provided with feedback on the participation of high performing neighbors because the utility customer may be motivated to join or beat his or her high performing neighbors. An energy efficient neighbor may be a utility customer that uses an amount of energy below a certain threshold level or a utility customer that is associated with an energy efficiency score that exceeds (or does not exceed) a certain threshold value. The number or percentage of participating utility customers among the utility customers in the selected group may be calculated and continuously updated during a DR event.

According to an embodiment, individualized DR event information may be provided to each participating utility customer. For example, a utility customer associated with at least one of the above-discussed characteristics (e.g., location information) may be identified. Thereafter, a group may be selected based on the at least one characteristic and individualized DR event feedback information may be generated and provided to the identified utility customer. Therefore, participation in DR events can be further improved.

Next, in block 120, the determined DR event feedback information is provided to at least one utility customer among the plurality of utility customers. As set forth above, the DR event feedback information may be transmitted to and displayed on a client device of the utility customer. This will be discussed in greater detail below with reference to FIGS. 5, 6A, 6B, 6C, 6D, 7A, 7B, 7C, 8A, 8B, 9A, 9B, 9C, 9D, 9E, 10A, and 10B.

Figure 2:
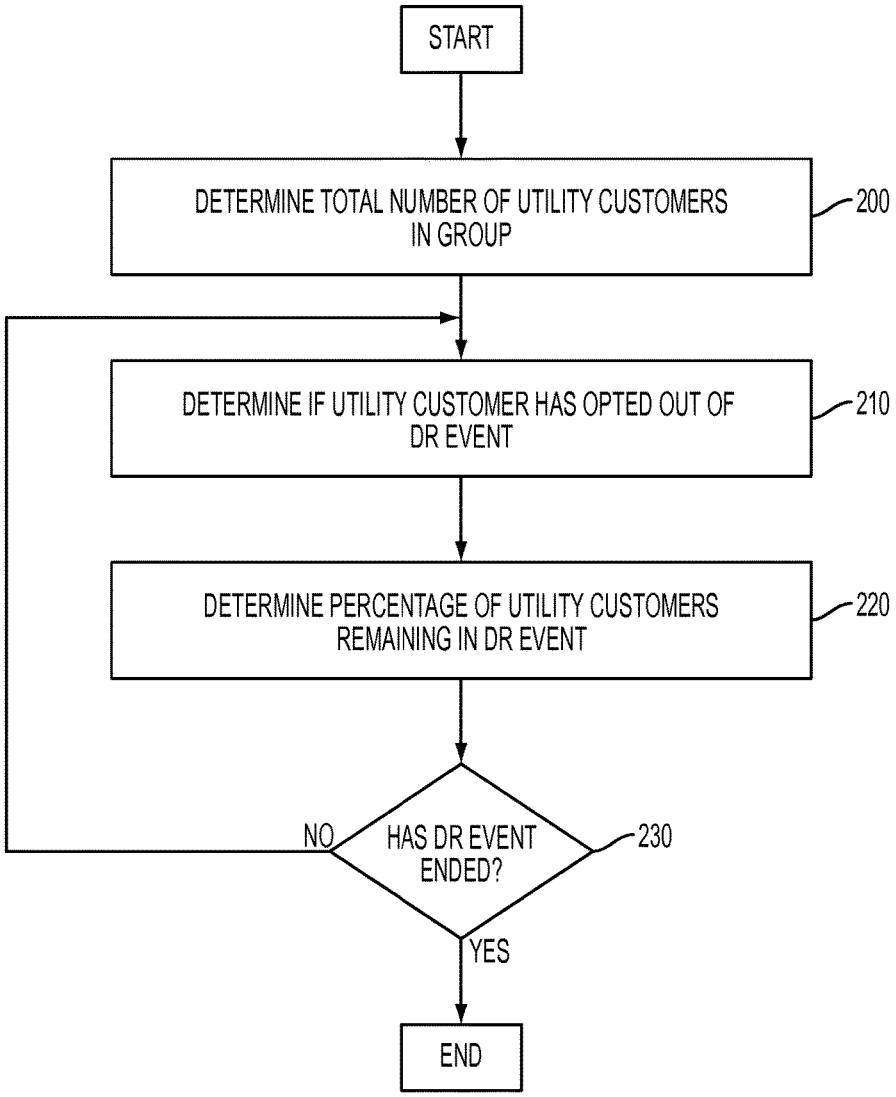
FIG. 2 is a flow diagram illustrating a process for determining a percentage of utility customers participating in a DR event, according to an embodiment.

FIG. 2 is a flow diagram illustrating a process for determining a percentage of utility customers participating in a DR event, according to an embodiment. The determined percentage of utility customers participating in the DR event may be used in determining the utility DR event feedback information as described above with reference to block 110 of FIG. 1.

Referring to FIG. 2, a total number of utility customers in a group is determined in block 200. For instance, as set forth above, a number of utility customers may be grouped together according to a certain algorithm or method. The group may include only those utility customers who have opted in or been selected to participate in a DR program. Alternatively, the group may include all utility customers targeted for DR events. In some embodiments, the group may include utility customers selected based on various factors or characteristics (e.g., similar customers, neighbors, energy efficient neighbors, etc.). Accordingly, the total number of utility customers in a group may be determined.

Next, in block 210, it is determined if a utility customer has opted out of the DR event. A utility customer may be able to opt out of the DR event prior to the DR event and/or during the DR event.

Next, in block 220, the percentage of utility customers remaining in the DR event is determined based on the total number of utility customers in the group and the number of utility customers that have opted out or that are still participating. In an embodiment, a utility customer participating in a DR program may be able to opt out of the DR event before it begins. Accordingly, the percentage of utility customers remaining in the DR event may be calculated before the DR event begins and updated until the DR event ends. Utility customers may be provided with participation information leading up to the DR event and throughout the DR event.

Next, in block 230, if the DR event has not ended, the process returns to block 210 to determine if any other utility customers have opted out of the DR event. Otherwise, if the DR event has ended, the process is terminated. Although the embodiment discussed with respect to FIG. 2 determines the percentage of utility customers in a DR event based on whether utility customers have opted out of the DR event, in other embodiments, the percentage of utility customers in a DR event may be determined based on whether utility customers have enrolled in a DR event or indicated that they will participate in a DR event.

Figure 3:
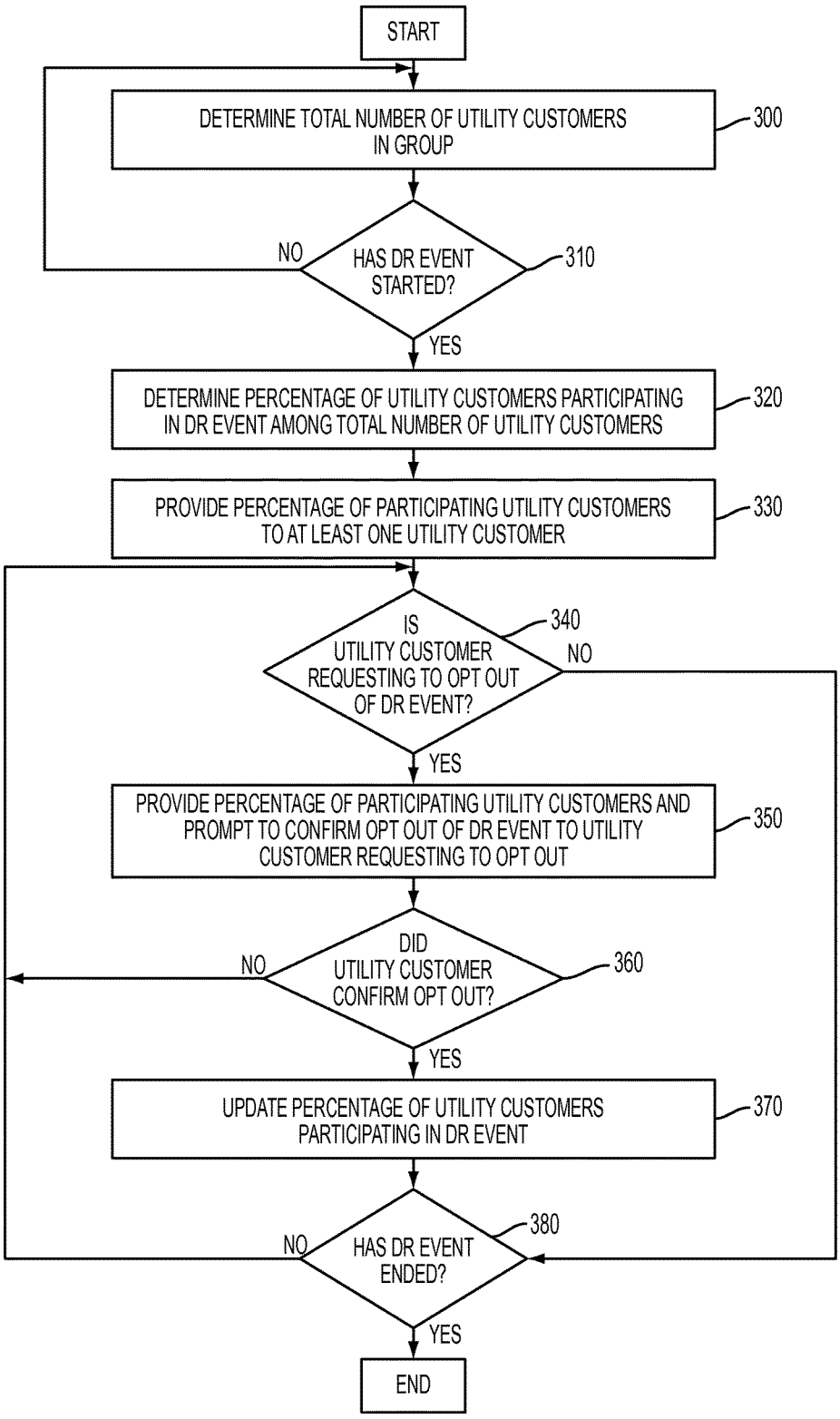
FIG. 3 is a flow diagram illustrating a process for determining a percentage of utility customers participating in a DR event and providing the determined percentage to at least one utility customer, according to an embodiment.

FIG. 3 is a flow diagram illustrating a process for determining a percentage of utility customers participating in a DR event and providing the determined percentage to at least one utility customer, according to an embodiment.

Referring to FIG. 3, a total number of utility customers in a group is determined in block 300. This has been described in detail above with reference to FIG. 2 and will not be described again in detail.

Next, in block 310, if the DR event has not started, the process returns to block 300. Otherwise, if the DR event has started, the process proceeds to block 320 and the percentage of utility customers participating in the DR event, among the total number of utility customers in the group, is determined. The embodiment is not limited thereto and the system may be configured to add utility customers during a DR event. In this case, the total number of utility customers may be updated during the DR event.

Next, in block 330, the determined percentage or number of participating utility customers and/or other feedback information is provided to at least one utility customer. The percentage or number of participating utility customers and/or other feedback information may be provided to participating utility customers to encourage the utility customers currently participating in the DR event to remain in the DR event and not opt out. According to another embodiment, the percentage or number and/or other feedback information may also be provided to utility customers who have opted out of the DR event and/or utility customers not participating in the DR program to encourage the non-participating utility customers to participate in future DR events.

Next, in block 340, if no utility customers are requesting to opt out of the DR event, the process determines if the DR event has ended, in block 380. Otherwise, if a utility customer is requesting to opt out of the DR event, the process may provide, to the utility customer requesting to opt out of the DR event, the percentage of participating utility customers, along with a prompt requiring that the utility customer confirm the request to opt out of the DR event, in block 350. This will be described in greater detail below with reference to FIG. 8A.

Next, in block 360, if the utility customer confirmed the request to opt out of the DR event, the percentage of utility customers participating in the DR event is updated, in block 370. Otherwise, if the utility customer did not confirm his or her request to opt out of the DR event (i.e., the utility customer decided to remain in the DR event) the process returns to block 340 and a determination is made as to whether or not any other utility customers are requesting to opt out of the DR event.

After the percentage of utility customers participating in the DR event is updated, in block 370, it is determined if the DR event has ended, in block 380. If the DR event has ended, the process is terminated. Otherwise, if the DR event has not ended, the process returns to block 340.

According to another embodiment, DR event feedback information may be additionally provided to utility customers in the form of e-mails, text messages, or other forms. According to yet another embodiment, a utility customer's participation in DR event programs, along with the participation of the other utility customers in the group of the utility customer, may be provided on the utility customer's utility bill.

Figure 4:
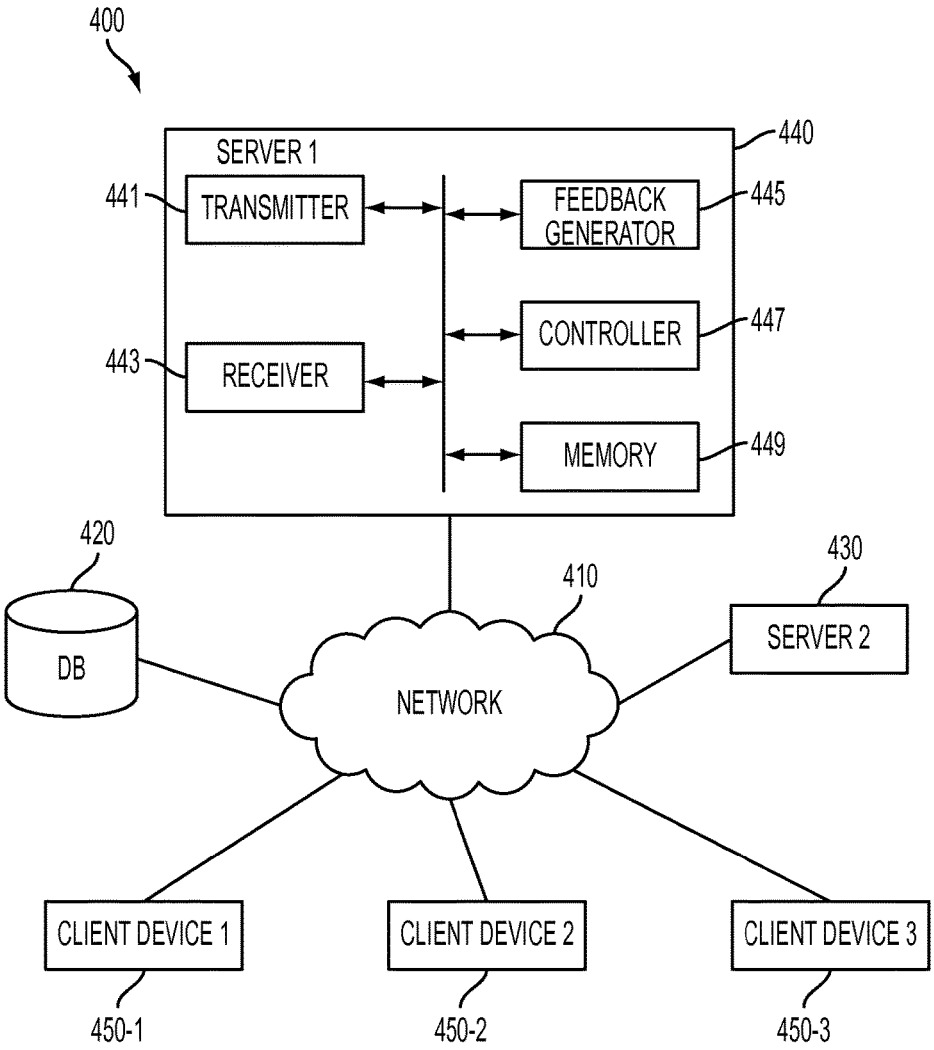
FIG. 4 is a block diagram illustrating a DR event participation system, according to an embodiment.

FIG. 4 is a block diagram that illustrates an embodiment of a network 400 including servers 430, 440 upon which the DR event participation system may be implemented and client devices 450-1, 450-2, 450-3 that communicate with the servers 430, 440. The client devices 450-1, 450-2, 450-3 will be described in greater detail below with reference to FIG. 5. Server 1 440 includes a transmitter 441, a receiver 443, a feedback generator 445, a controller 447, and a memory 449. The feedback generator 445 and the controller 447 may include at least one of a processor, a hardware module, or a circuit for performing their respective functions. Although not illustrated, server 2 430 may be similarly embodied. The client devices 450-1, 450-2, 450-3 communicate across the Internet or another wide area network (WAN) or local area network (LAN) 410 with server 1 440 and server 2 430. Server 1 440 and server 2 430 may also communicate with database 420 across the Internet or another wide area network (WAN) or local area network (LAN) 410.

The feedback generator 445, controller 447, and memory 449 operate to execute instructions, as known to one of skill in the art. The term "computer-readable storage medium" as used herein refers to any tangible medium, such as a disk or semiconductor memory, that participates in providing instructions to the feedback generator 445 or controller 447 for execution.

According to an embodiment, one or both of server 1 440 and server 2 430 may implement the DR event participation system. For example, server 1 440 and/or server 2 430 may be located at a utility company, a third-party site, or any other location and may be configured to receive information from the client devices 450-1, 450-2, 450-3, database 420, or another source (e.g., the utility company, a thermostat manufacturer, a third-party database, or any other source) regarding participation information in DR events or programs. Server 1 440 and/or server 2 430 may segment the utility customers into groups, determine DR event feedback information based on the received information, and communicate the determined DR event feedback information to the client devices 450-1, 450-2, 450-3 and/or to the database 420, the utility company, the thermostat manufacturer, a third-party database, or any other source. However, this is merely exemplary and the system may be implemented on a single server or on more than two servers. Further, the database 420 may be optionally omitted.

Figure 5:
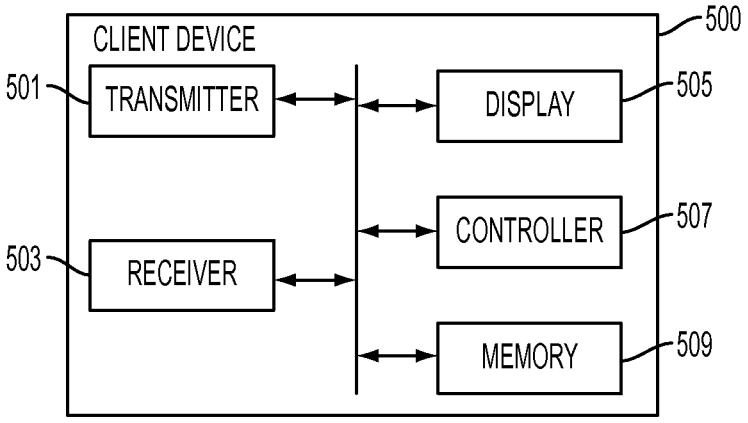
FIG. 5 is a block diagram illustrating a client device, according to an embodiment.

FIG. 5 is a block diagram that illustrates an embodiment of a client device 500 upon which an embodiment may be implemented. The client device 500 includes a transmitter 501, a receiver 503, a display 505, a controller 507, and a memory 509. The transmitter 501 may be configured to transmit participation information to server 1 440, server 2 430, and/or database 420. The receiver 503 may be configured to receive, from server 1 440, server 2 430, and/or database 420, information including the DR event feedback information and additional information. The additional information will be described in greater detail with reference to FIGS. 6A, 6B, 6C, 6D, 7A, 7B, 7C, 8A, 8B, 9A, 9B, 9C, 9D, 9E, 10A, and 10B.

The controller 507 and the memory 509 operate to execute instructions, as known to one of skill in the art. The controller 507 may include at least one of a processor, a hardware module, or a circuit for performing its respective functions. The display 505 may be configured to display the received information. Further, the display 505 may be a touchscreen display and may act as an input device for interacting with a utility customer or other user. The client device 500 may connect to the network 410 using wireless protocols, such as 802.11 standards, Bluetooth®, or cellular protocols, or via physical transmission media, such as cables or fiber optics.

The client device 500 may be embodied in many different forms such as a smartphone, a mobile device, a thermostat, a computer, a device having a graphical UI (GUI) from which a thermostat set point can be selected or adjusted, etc. The GUI may be accessed through an application installed on a utility customer's smartphone or through a browser displaying the utility customer's utility account. Therefore, a utility customer may be able to remotely control his or her thermostat and participate in DR events.

FIGS. 6A, 6B, 6C, 6D, 7A, 7B, 7C, 8A, 8B, 9A, 9B, 9C, 9D, 9E, 10A, and 10B illustrate a UI of a client device, according to an embodiment. For convenience, an embodiment illustrating a UI of a smartphone, on which an application implementing an embodiment is installed, is illustrated. However, the embodiment is not limited thereto, and any device having a display, e.g., a computer (not illustrated), a thermostat (not illustrated), etc., may constitute the client device 500. In the following figures, redundant explanation of the same elements as those of previous figures is omitted.

Figure 6A:
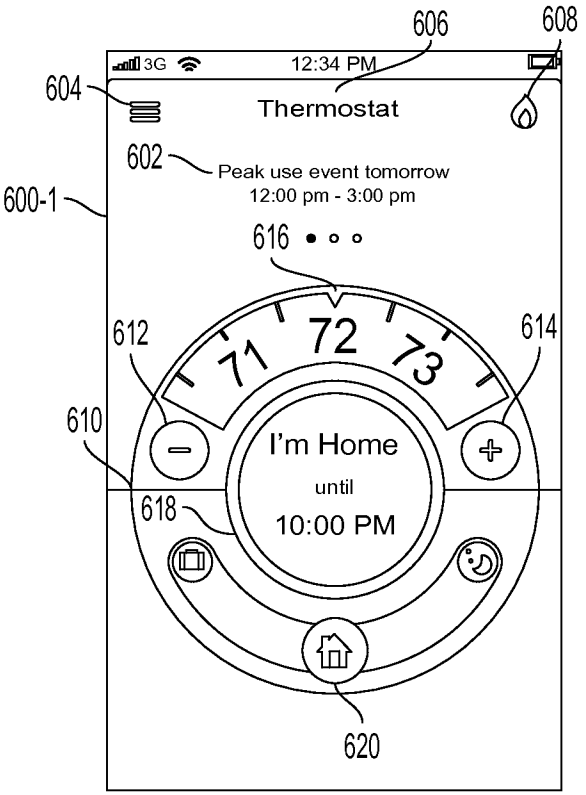
FIGS. 6A, 6B, 6C, 6D, 7A, 7B, 7C, 8A, 8B, 9A, 9B, 9C, 9D, 9E, 10A, and 10B illustrate a user interface (UI) of a client device, according to an embodiment.

Referring to FIG. 6A, a screen 600-1 illustrating a GUI in which a thermostat set point can be selected is displayed. Screen 600-1 may be displayed when a utility customer opens an application installed on a smartphone. As shown in screen 600-1, a current temperature set point (i.e., "72") 616 of, e.g., the utility customer's home, may be displayed. The utility customer can adjust the current temperature set point using buttons 612, 614 to control the heating or cooling systems in the utility customer's home. A current schedule 618 of the utility customer may be displayed. For example, in order to save energy, the thermostat may be programmed to keep the house at an optimal temperature only when the utility customer is scheduled to be home (e.g., before 10:00 p.m.). One or more icons 620 may also be displayed to indicate the current schedule period and other schedule periods (e.g., "home," "away," "sleep," etc.).

Because there are a number of different screens that may be displayed on the smartphone, a page identifier (i.e., "Thermostat") 606 may be displayed to indicate to the utility customer that the currently displayed page corresponds to the utility customer's thermostat. Icon 608 may be displayed to identify a current program or mode. For example, a flame icon may be displayed to indicate a heating program, and a snowflake icon (not illustrated) may be displayed to indicate a cooling program. Finally, a thermostat message 602 which may provide relevant information about scheduled, active, and/or completed DR events may be displayed.

Figure 6B:
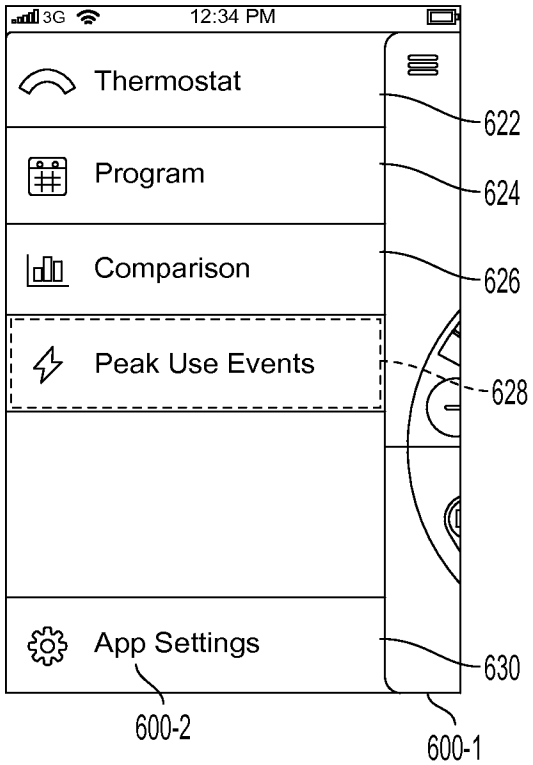

If the utility customer selects the menu button 604, a screen 600-2 may be displayed, as shown in FIG. 6B. Also, as shown in FIG. 6B, a portion of the screen 600-1 may also be displayed. The utility customer may navigate back to the screen 600-1 by swiping the screen toward the left side of the smartphone or by tapping on the screen 600-1. The screen 600-2 may display a navigation menu including menu items "Thermostat" 622, "Program" 624, "Comparison" 626, and "Peak Use Events" 628. "Peak Use Events" 628 may be displayed for utility programs that have a DR component. The utility customer may select "Thermostat" 622 to return to screen 600-1. The utility customer may select "Program" 624 to navigate to a screen displaying currently programmed heating/cooling schedule along with an interface for modifying the currently programmed schedule (not illustrated). The utility customer may select "Comparison" 626 to navigate to a screen displaying, for example, the utility customer's energy usage and participation in DR events as compared to the other utility customers in the group to which the utility customer belongs (not illustrated). The utility customer may select "Peak Use Events" 628 to learn about the DR events and to get real-time information about scheduled, active, and completed DR events. Further, "App Settings" 630 may be displayed. The utility customer may select "App Settings" 630 to navigate to a screen where the utility customer can make changes to the settings of the installed application.

Figure 6C:
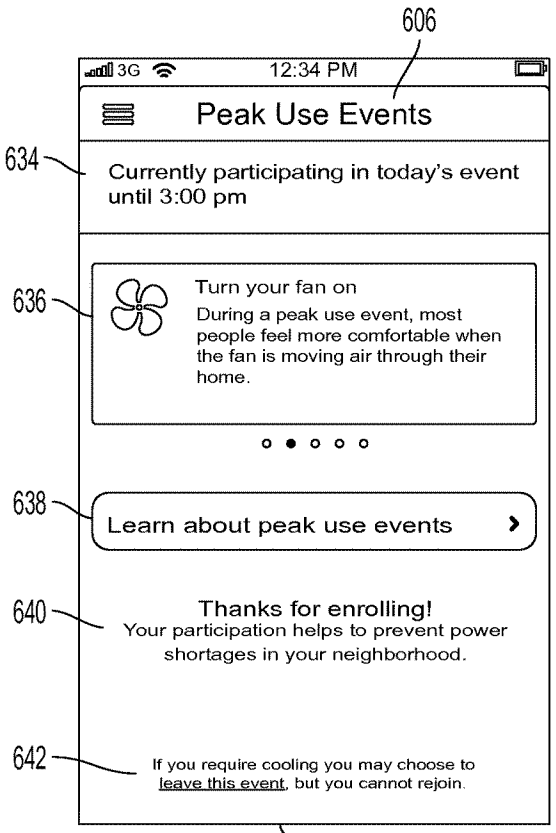

If the utility customer selects "Peak Use Events" 628, screen 600-3 is displayed, as shown in FIG. 6C. In screen 600-3, the page identifier 606 may be updated to display "Peak Use Events." Further, screen 600-3 may display a message band 634, an additional information box 636, a link or button to select for additional information about peak use events 638, a thank you message 640, and an opt out link or button 642.

The message band 634 may display information about scheduled, active, and completed DR events. For example, the message band may display participation information (e.g., DR event feedback information) and information to encourage participation during DR events. The additional information box 636 may provide utility customers with a set of tips designed to help them stay conformable during a DR event along with other information to motivate them to remain in the DR event (i.e., not opt out). The additional information box will be described in greater detail below with reference to FIGS. 9A, 9B, 9C, 9D, and 9E. The link or button for additional information about peak use events 638 is a selectable link or button for navigating to a screen displaying information about peak use events and what to expect during a DR event. This will be described in greater detail with reference to FIG. 6D below. The opt out link or button 642 may be provided to enable the utility customer to opt out of a DR event, if for instance, they require cooling during the DR event. The opt out link 642 may display a reminder that if a utility customer opts out of a DR event, they cannot later opt back in to the DR event.

Figure 6D:
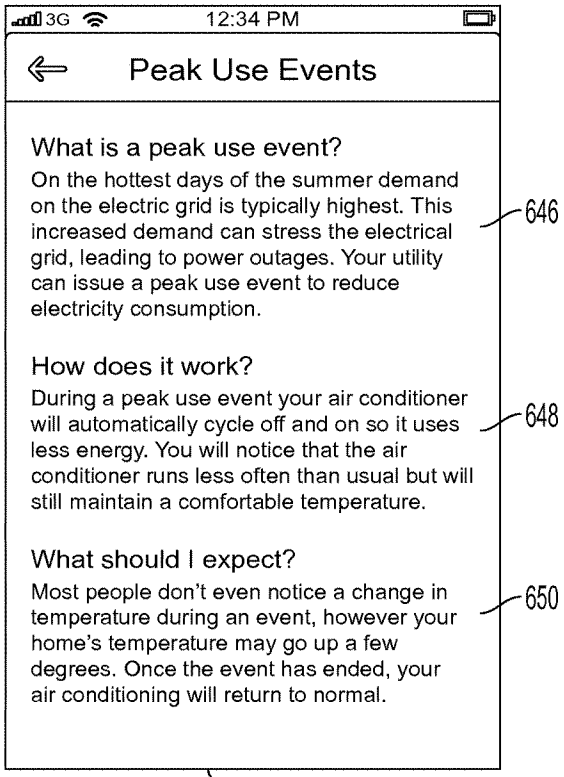

If the utility customer selects "Learn about peak use events" 638, screen 600-4 is displayed, as shown in FIG. 6D. Screen 600-4 may provide utility customers with useful information and answers to frequently asked questions about what a peak use event is (i.e., "What is a peak use event?") 646, how their heating, ventilation, and air conditioning (HVAC) equipment operation will be modified (i.e., "How does it work?") 648, and what to expect during a DR event (i.e., "What should I expect?") 650.

Figure 7A:
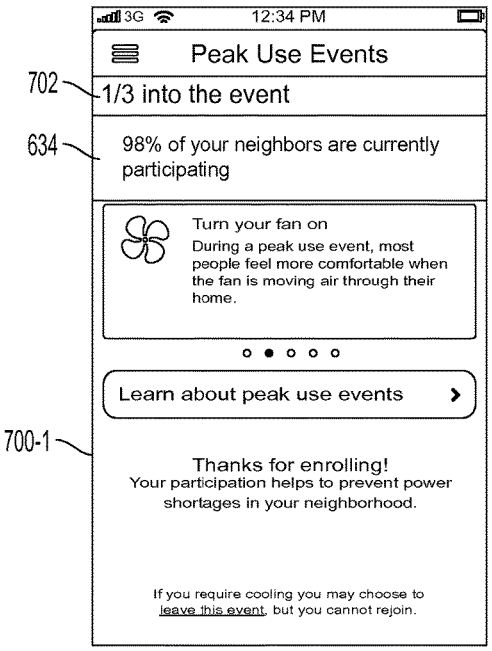
Figure 7B:
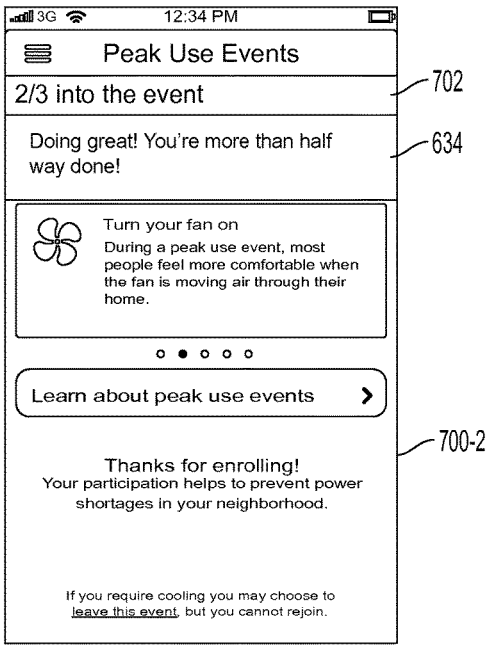
Figure 7C:
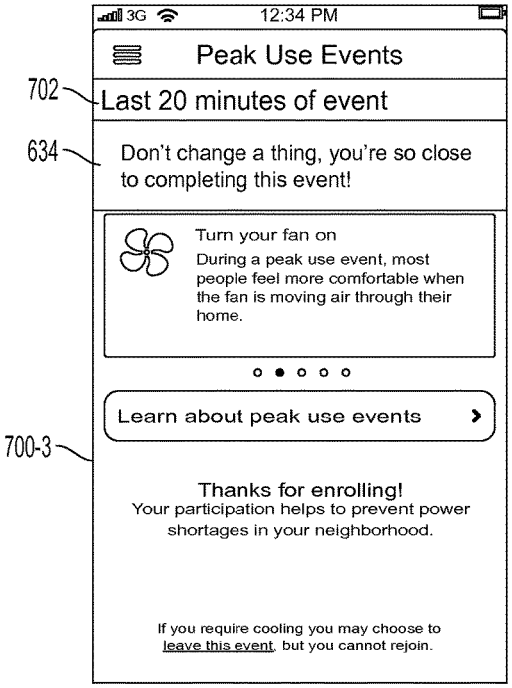

FIGS. 7A, 7B, and 7C illustrate different "Peak Use Event" screens which may be displayed during a DR event corresponding to a peak use event.

Referring to FIG. 7A, during a DR event corresponding to a peak use event, the message band 634 may display DR event feedback information. For example, if the group of utility customers is determined to be all of the utility customers within a neighborhood, the percentage of utility customers participating in the DR event may be calculated and displayed. As shown in FIG. 7A, if 98% of the utility customers in the neighborhood are currently participating in the DR event, the message band 634 may display "98% of your neighbors are currently participating." Furthermore, the time completed/remaining in the DR event may be displayed in the message band 702.

Referring to FIG. 7B, when the DR event is two-thirds completed, screen 700-2 may be displayed. In screen 700-2, the time completed/remaining in the DR event may be updated so that "⅔ into the event," may be displayed in the message band 702. Further, the message band 634 may be updated to display words of encouragement to encourage the utility customer to complete the DR event. For example, the message band 634 may be updated to display "Doing great! You're more than half way done!"

Referring to FIG. 7C, when the DR event is approaching its conclusion (e.g., has 20 minutes remaining), screen 700-3 may be displayed. In screen 700-3, the time completed/remaining in the current DR may be updated so that a message such as "Last 20 minutes of event" is displayed in the message band 702. Further, the message band 634 may be updated to display different words of encouragement to encourage the utility customer to complete the DR event. For example, the message band 634 may be updated to display "Don't change a thing, you're so close to completing this event!"

Figure 8A:
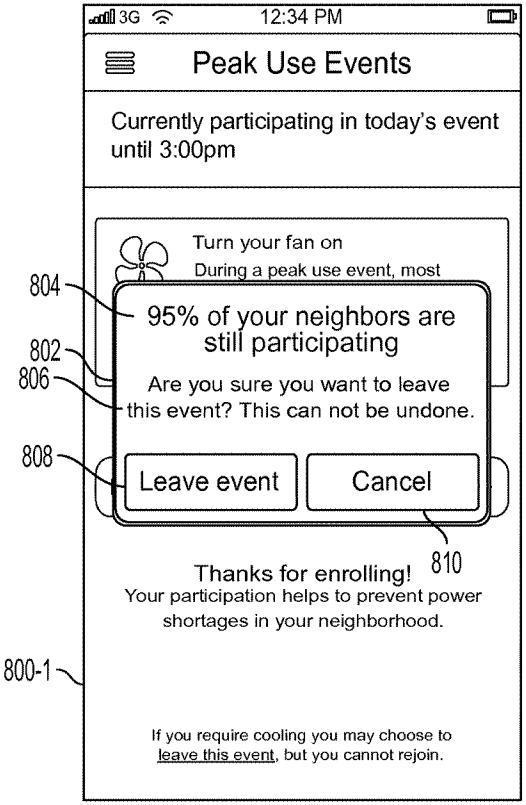

Referring to FIG. 8A, when a utility customer is participating a DR event and requests to opt out (e.g., step 340 in FIG. 3), DR event feedback information such as "95% of your neighbors are still participating" 804, may be provided to the utility customer, along with a prompt, "Are you sure you want to leave this event? This cannot be undone" 806 (e.g., step 350 of FIG. 3). As set forth above, the utility customer may request to opt out of the DR event by selecting the link or button 642, as shown in FIG. 6C. If the utility customer initiates a request to opt out of the DR event, the utility customer is prompted to confirm or cancel the request to opt out using the selectable buttons 808, 810 (e.g., step 360 of FIG. 3). If the utility customer confirms the request to opt out, the percentage of utility customers participating in the DR event is updated (e.g., step 370 in FIG. 3) and screen 800-2 is displayed, as shown in FIG. 8B.

Figure 8B:
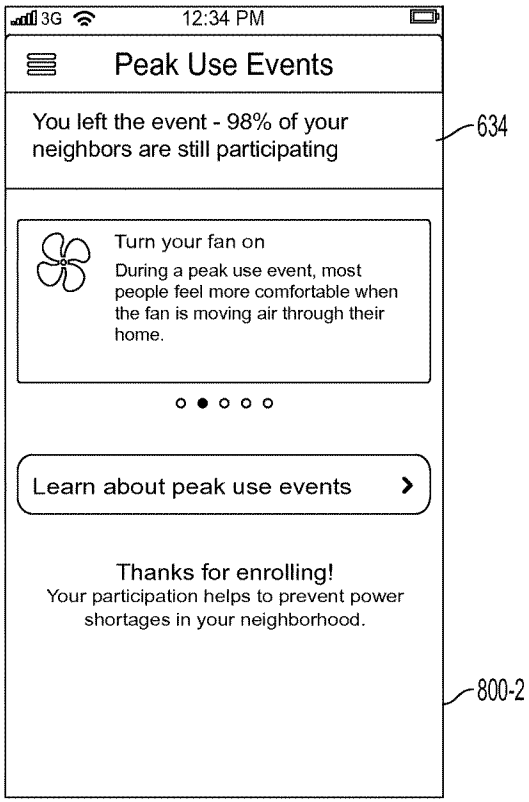

Referring to FIG. 8B, in screen 800-2, the message band 634 may be updated to display "You left the event—98% of your neighbors are still participating."

Figure 9A:
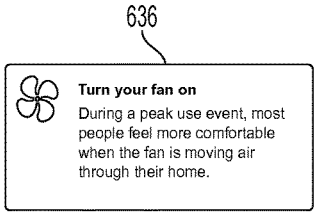
Figure 9B:
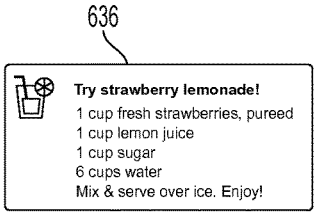
Figure 9C:
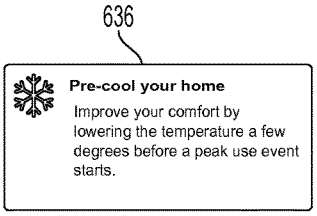
Figure 9D:
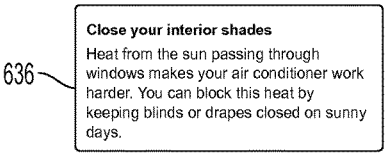
Figure 9E:
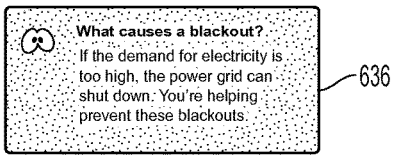

FIGS. 9A, 9B, 9C, 9D, and 9E illustrate different additional information that may be displayed in additional information box 636, which is displayed on various screens. For instance, FIG. 9A illustrates a tip instructing the utility customer to "Turn your fan on" so that the utility customer may be more comfortable during a DR event and therefore less likely to leave the DR event. FIG. 9B illustrates a tip with a recipe for strawberry lemonade. FIG. 9C illustrates a tip to "Pre-cool your home." FIG. 9D illustrates a tip to "Close your interior shades." Finally, FIG. 9E illustrates information on "What causes a blackout?" This additional information is exemplary and is not limited thereto. Accordingly, any tips or information to improve a utility customer's comfort during a DR event and therefore increase the likelihood of the utility customer completing the DR event may be displayed.

Figure 10A:
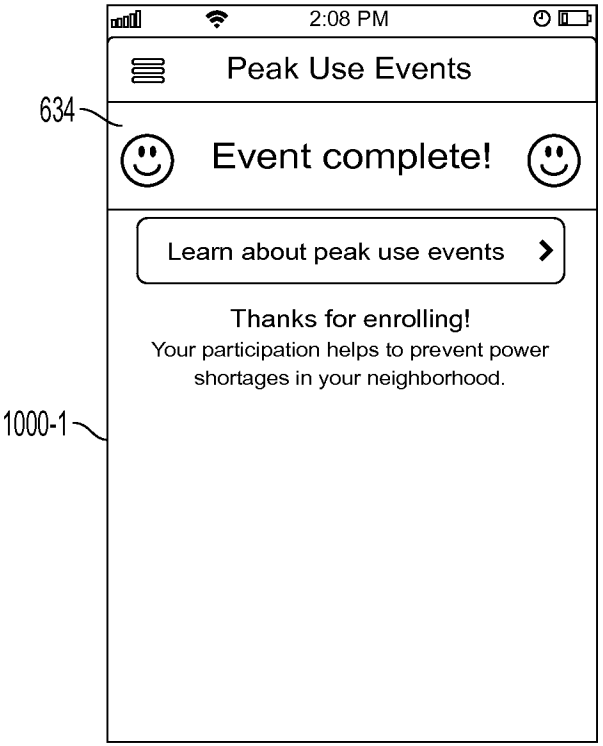
Figure 10B:
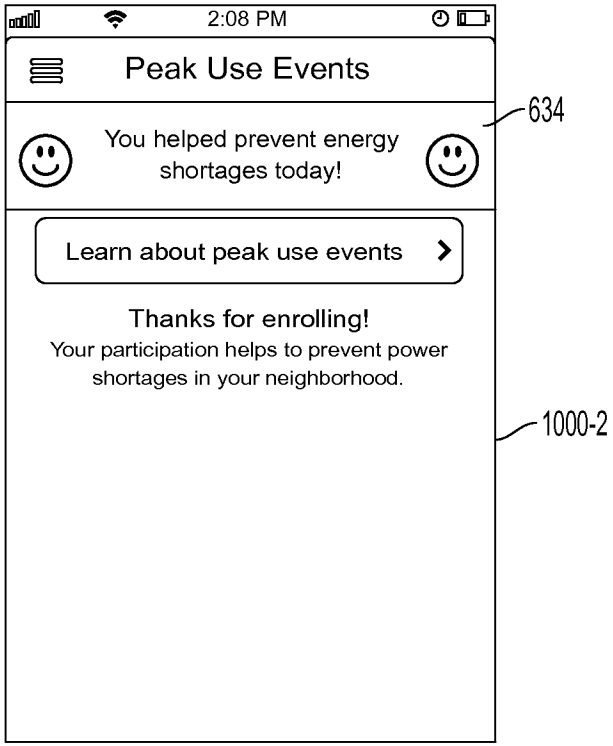

Referring to FIG. 10A, screen 1000-1 may be shown when the DR event ends. In FIG. 10A, the message band 634 may be updated to "Event complete!" Screen 1000-2 may display a message encouraging the utility customer. For example, the message band 634 may be updated to display "You helped prevent energy shortages today!"

The foregoing detailed description has set forth various embodiments via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware, software, or virtually any combination thereof, including software running on a general purpose computer or in the form of a specialized hardware.

While certain embodiments have been described, these embodiments have been presented by way of example only, and are not intended to limit the scope of the protection. Indeed, the novel methods and apparatuses described herein may be embodied in a variety of other forms. Furthermore, various omissions, substitutions and changes in the form of the methods and systems described herein may be made without departing from the spirit of the protection. The accompanying claims and their equivalents are intended to cover such forms or modifications as would fall within the scope and spirit of the protection.

What is claimed is:

1. A method for providing information about participation in a utility demand response (DR) event by a plurality of utility customers, the method performed by a computing device including at least a processor, the method comprising:

receiving information regarding participation in the DR event by the plurality of utility customers;

determining DR event feedback information using the processor and the received information regarding participation in the DR event;

determining, by the processor, a percentage or a number of utility customers participating in the DR event based on at least the DR event feedback information;

providing the DR event feedback information to a client device associated with at least one utility customer from among the plurality of utility customers;

wherein the providing comprises transmitting, to the client device for display on the client device, the percentage or the number of utility customers participating in the DR event;

receiving one or more requests from utility customers to opt out of the DR event during the DR event;

determining a number of utility customers opting out during the DR event based upon a count of the one or more requests;

calculating a number of new utility customers to add to the DR event based upon the number of utility customers opting out; and in response to receiving the one or more requests, adding the number of new utility customers to the DR event during the DR event; and executing the DR event, comprising executing a DR program configured to reduce energy consumption by a plurality of participating utility customers during a peak use event.

2. The method of claim 1, wherein the adding the number of new utility customers further comprises requesting one or more utility customers to enroll in the DR event.

3. The method of claim 1, wherein the peak use event comprises an event in which a total energy consumption level in an energy system is predicted to exceed a predetermined threshold.

4. The method of claim 1, further comprising selecting the plurality of utility customers, wherein the selected plurality of utility customers comprises a plurality of utility customers of a same energy substation.

5. The method of claim 1, further comprising:

in response to receiving a request from the client device to opt out of the DR event, transmitting to the client device for display on a graphical user interface, the percentage or the number of utility customers participating in the DR event and a prompt to confirm the request to opt out or to cancel the request to opt out.

6. The method of claim 1, wherein the providing the DR event feedback comprises displaying the DR event feedback on.

7. The method of claim 1, wherein the percentage or the number of utility customers participating in the DR event is displayed within the graphical user interface that includes an interface in which a thermostat set point is selected.

8. A system for providing information about participation in a utility demand response (DR) event by a plurality of utility customers, the system comprising:

a receiver configured to receive information regarding participation in the DR event by the plurality of utility customers;

a feedback generator configured to:

(i) determine, using a processor, DR event feedback information using the received information regarding participation in the DR event;

(ii) determine, by the processor, a percentage or a number of utility customers participating in the DR event based on at least the DR event feedback information;

(iii) receive, by the processor, one or more requests from utility customers to opt out of the DR event during the DR event;

(iv) determine, by the processor, a number of utility customers opting out during the DR event based upon a count of the one or more requests;

(v) calculate, by the processor, a number of new utility customers to add to the DR event based upon the number of utility customers opting out; and (vi) in response to receiving the one or more requests, add, by the processor, the number of new utility customers to the DR event during the DR event; and a transmitter configured to transmit at least a portion of the DR event feedback information to at least one client device for display on the client device, wherein the portion includes the percentage or the number of utility customers participating in the DR event; and the system configured to execute the DR event, comprising executing a DR program configured to reduce energy consumption by a plurality of participating utility customers during a peak use event.

9. The system of claim 8, wherein the DR event comprises a DR program configured to reduce energy consumption during a peak use event by controlling a thermostat of each of the plurality of participating utility customers to cycle off a heating or cooling system for a period of time or change a thermostat set point.

10. The system of claim 9, wherein the peak use event comprises an event in which a total energy consumption level in an energy system exceeds or is predicted to exceed a predetermined threshold or an event in which a price of energy in the energy system exceeds a predetermined threshold for a period of time.

11. The system of claim 8, wherein the feedback generator is further configured to select the plurality of utility customers, and wherein the selected plurality of utility customers comprises a plurality of utility customers of a same utility program.

12. The system of claim 8, wherein the transmitter is further configured to transmit additional DR event feedback comprising at least one of information corresponding to a future DR event, information corresponding to the DR event, or information corresponding to a completed DR event, to the at least one client device.

13. The system of claim 8, wherein the at least one client device comprises.

14. A non-transitory computer readable medium storing instructions for execution by a device that when executed cause the device to:

identify a utility customer associated with at least one characteristic;

select a plurality of utility customers based on the at least one characteristic;

receive information regarding participation of the plurality of utility customers in a demand response (DR) event;

determine DR event feedback information using a processor and the received information regarding participation in the DR event;

determine, by the processor, a percentage or a number of utility customers participating in the DR event based on at least the DR event feedback information;

provide the DR event feedback information to a client device associated with the identified utility customer;

wherein the providing comprises transmitting, to the client device for display on the client device, the percentage or the number of utility customers participating in the DR event to encourage participation in the DR event;

receive one or more requests from utility customers to opt out of the DR event during the DR event;

determine a number of utility customers opting out during the DR event based upon a count of the one or more requests;

calculate a number of new utility customers to add to the DR event based upon the number of utility customers opting out; and in response to receiving the one or more requests, add the number of new utility customers to the DR event during the DR event; and execute the DR event, comprising executing a DR program configured to reduce energy consumption by a plurality of participating utility customers during a peak use event.

15. The non-transitory computer readable medium of claim 14, wherein the at least one characteristic comprises a location associated with the identified utility customer, and wherein the plurality of utility customers is selected based on the location associated with the identified utility customer.

* * * * *